United States Patent [19]

Tanham

[11] 4,169,406

[45] Oct. 2, 1979

[54] BOX-FOLDING MACHINE AND METHOD OF SETTING UP SAME

[75] Inventor: Horst Tanham, Wuppertal, Fed. Rep. of Germany

[73] Assignee: Escomat Maschinenbau Schmitt & Co., Wuppertal, Fed. Rep. of Germany

[21] Appl. No.: 856,334

[22] Filed: Nov. 30, 1977

[30] Foreign Application Priority Data

Dec. 2, 1976 [DE] Fed. Rep. of Germany ..... 2654641

[51] Int. Cl.[2] ..... B31B 1/14

[52] U.S. Cl. ..... 93/49 AC

[58] Field of Search ..... 83/499, 504; 93/49 R, 93/49 AC, 49 M, 52, 61 AC, 58.2 R

[56] References Cited

U.S. PATENT DOCUMENTS

| | | | |
|---|---|---|---|
| 3,379,103 | 4/1968 | Treff | 93/61 AC |
| 3,540,340 | 11/1970 | Koskela | 83/499 |
| 3,656,416 | 4/1972 | Baum | 93/52 |
| 3,760,697 | 9/1973 | Besemann | 83/499 |
| 3,882,764 | 5/1975 | Johnson | 83/504 |

FOREIGN PATENT DOCUMENTS

| | | | |
|---|---|---|---|
| 547671 | 4/1974 | Switzerland | 83/499 |

*Primary Examiner*—Gerald A. Dost

*Attorney, Agent, or Firm*—Michael J. Striker

[57] ABSTRACT

In a box-making machine a flat blank is passed longitudinally by a conveyor through a plurality of treatment stations at each of which a treatment element displaceable transversely to the conveyor acts on the blank to fold it up into a three-dimensional box. Each of the treatment elements is carried on a respective threaded spindle that can be rotated to position it transversely of the conveyor, and each spindle is connected via a respective electromagnetic clutch to a common drive chain. Also driven by this drive chain is a control spindle carrying a scanning device which can move past a blank or the like and generate a succession of position signals. The scanning device and the treatment elements are all jointly and synchronously displaced in one direction across the conveyor and as each of the position signals is generated the respective treatment element is arrested so that all of the treatment elements can be exactly positioned in one operation.

8 Claims, 8 Drawing Figures

BOX-FOLDING MACHINE AND METHOD OF SETTING UP SAME

BACKGROUND OF THE INVENTION

The present invention relates to a method of and apparatus for converting a flat blank into a box. More particularly this invention concerns the setting-up of such a machine for folding a flat normally cardboard blank into a semi-finished blank which is in collapsed state, ready to be folded out to assume a three-dimensional shape.

In the packaging industry it is standard practice to ship boxes in the form of collapsed semi-finished blanks which are folded by the user into the desired three-dimensional shape. A collapsed semi-finished blank is much easier to handle and ship than a set-up box.

Normally the conversion of flat blanks to semi-finished collapsed-box blanks is carried out in a large-scale operation by an automatic machine having a conveyor that displaces the flat blank through a plurality of treatment stations. Each of these stations is provided with a respective treatment element that creases the blank, folds it, applies adhesive or latex to it, or otherwise acts on it. Thus the flat blank in passing through these various treatment stations is converted into semi-finished collapsed-box blank which is ready to be transformed into a three-dimensional box.

For each different box to be set up it is normally necessary to perform a number of adjustment on the machine, frequently as many as ten. The various treatment elements must all be displaced normally transversely of the conveyor or conveyor path from the upstream end to the downstream end of the machine into positions corresponding to the seam lines, creases, or the like of a normally cardboard blank that is fed to the machine at the upstream end thereof. In the most common type of arrangement each of these treatment elements, which may be a creasing iron, a latexing roller, an inclined folder or the like is carried on a respective threaded spindle extending across the machine conveyor. Each of these spindles has at one end a handwheel that can be rotated to displace the respective treatment element in either transverse direction of the conveyor. Thus each of these handwheels is operated to set the respective treatment element at the respective location, then several blanks are run through the machine and readjustments are made until the machine is operating correctly and properly setting up the blanks.

A standard heavy-duty machine of this kind can produce as many as a hundred thousand semi-finished (i.e., collapsed but ready to be set up) boxes per hour. The adjusting operation takes normally a half-hour. Thus during this downtime a production capacity of fifty thousand boxes is lost. What is more it is frequently very difficult to establish the exact position for each of the treatment element in one operation. Thus it is normally necessary slowly to run the blank through the machine, stopping its conveyor with the blank in each of the treatment stations and then displacing a respective treatment element into the appropriate position. Thus in a typical machine five to ten separate adjustments must be made to set the machine up for a new blank. A machine of this general type is disclosed in German Allowed Application (DAS) No. 1,270,940, especially in FIGS. 2 and 3, to which reference may be had for information.

SUMMARY OF THE INVENTION

It is therefore an object of the present invention to provide an improved method of and apparatus for folding a flat blank into a collapsed semi-finished box ready to be converted into a three-dimensional box.

Another object is the provision of an improved method for setting up such a folding machine.

A further object is to provide an improved folding machine which can rapidly and easily be set up for differently dimensioned blanks.

These objects are attained according to the present invention in a method of setting up a box-making machine of the above-described type wherein first a plurality of set positions each corresponding to a respective fold line and each associated with a respective treatment element is established along a predetermined path. A scanning device is displaced along the path past the set positions and synchronously therewith the treatment elements are displaced transversely of the conveyor. As the scanning device passes through or arrives at each of the respective set positions the respective treatment element is arrested. Thus it is merely necessary to establish the various set positions for the various treatment elements at a location which may be remote from the machine and thereafter to synchronously and jointly displace the treatment elements with the scanning device through these positions, with each of the treatment elements being arrested when the scanning device reaches the respective set position.

In accordance with this invention the set positions may be established simply with reference to a flat blank that itself may be scanned, or with respect to which pointers on trips or switching members may be set.

According to further features of this invention alignment means is provided which includes an alignment guide defining an alignment path which establishes the set positions. The scanning device includes a scanning element which is connected via a control arrangement to an actuator that jointly displaces the treatment elements and the scanning element. This control means or arrangement serves to arrest each of the treatment elements when the scanning element arrives at the respective set position. Thus each of the set positions corresponds to a desired value and the treatment elements are displaced until their actual value is the same as this desired value. The desired value can be established by means of a perforated card, individual dials for the respective treatment elements, cams or the like. Thus it is possible at one remote location if desired to establish the positions for all of the treatment elements and to set them in one simple and quick operation. It is not necessary, as in the prior art, painstakingly to establish the setting for each of the treatment elements individually and to carry out such a setting in a slow sequential manner.

The set positions may be established in accordance with this invention with reference to a blank to be folded into a box. To this end the blank may be positioned adjacent or underneath the alignment guide. A photocell-type scanner may pass along the alignment guide to optically pick up the seams corresponding to the various set positions. It is also possible to align a position-defining member with each of the creases or fold lines in the blank and to fix it at the respective position on the alignment guide. A switching device or trip may then be displaced past all of these position-defining members. Each of the members may carry a respective switch that controls the respective treatment element, or the element displaced past the trips may carry one or more switches that operate the respective treatment elements.

Thus with the machine according to the present invention it is of relatively simple operation to set the treatment elements in the proper positions for a new blank. First of all all the treatment elements are displaced to one side of the machine and the scanning element is displaced to the corresponding end of its path. Then the various trips are set on the alignment guide in registry with the fold or glue lines of a blank to be set up. The device is then started up and, as the scanning element comes to each of the respective trips, the respective treatment element stops, until all of the treatment elements lie in the exact positions determined at the alignment guide. In such a system it is therefore possible to set up an entire machine for a new blank in a matter of several minutes, thus greatly reducing the downtime and increasing the efficiency of plant operation.

According to further features of this invention the actuator means for the scanning element and the treatment elements includes a plurality of threaded spindles. The spindles carrying the treatment elements extend perpendicular to the conveyor, and the spindle carrying the scanning element extends along or parallel to the scanning path. Each of the spindles for the treatment elements is connected via a respective electromagnetic clutch to a respective sprocket. These sprockets all engage a common drive chain that also passes around a sprocket fixed on the spindle for the scanning element. A common drive motor operates this chain and, therefore, synchronously displaces the scanning element and the treatment elements. An end switch is provided for shutting off the drive motor when the scanning element reaches its end positions and another such limit switch is provided at each end of the travel of each of the treatment elements to open the respective electromagnetic clutch when the respective treatment element arrives at the end position at the side of the machine.

With the machine according to the present invention it is therefore possible to set the machine up for a new blank even while it is still processing old blanks. Thus a new blank can be positioned underneath the alignment guide and various trips or pointers aligned with the respective seams, edges, creases, or the like of the new blank. Once the last old blank is completely set up a switch is operated which automatically displaces all of the treatment elements to one side of the conveyor path, to a position corresponding to the smallest possible blank to be treated. Then the automatic setting operation is commenced and the treatment elements are automatically positioned in the proper locations for the new blank. Thereafter the machine can be started up again for processing of these new blanks. It is possible in such an arrangement to set the machine up to process a new blank in the amount of time it takes for another worker to load a supply of the new blanks into the feed location at the upstream end of the conveyor path. Virtually no time is lost in changeover of the machine, as compared to prior art machines where the changeover was laborious and required skilled personnel. In fact it has been found that it is usually possible to set the machine up for processing differently dimensioned blanks in less than one minute. Futhermore the trial-and-error system of the prior art which frequently lead to jamming or destruction of at least the first several blanks is completely avoided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
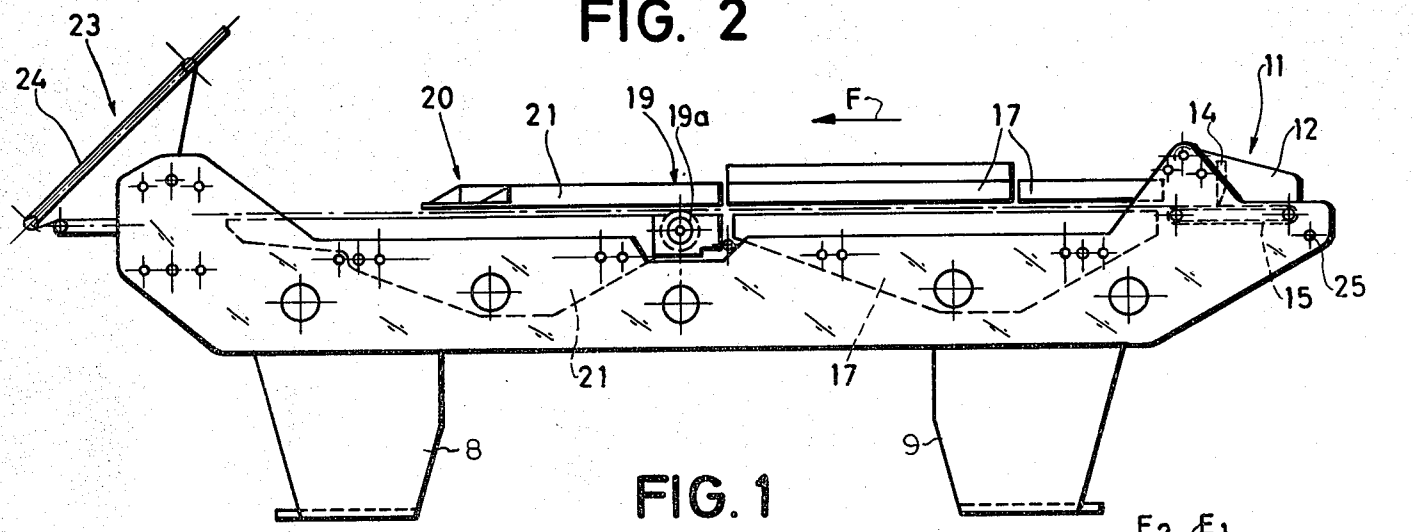
FIGS. 1 and 2 are top and side largely schematic views of a box-making machine according to the instant invention.
Figure 1:
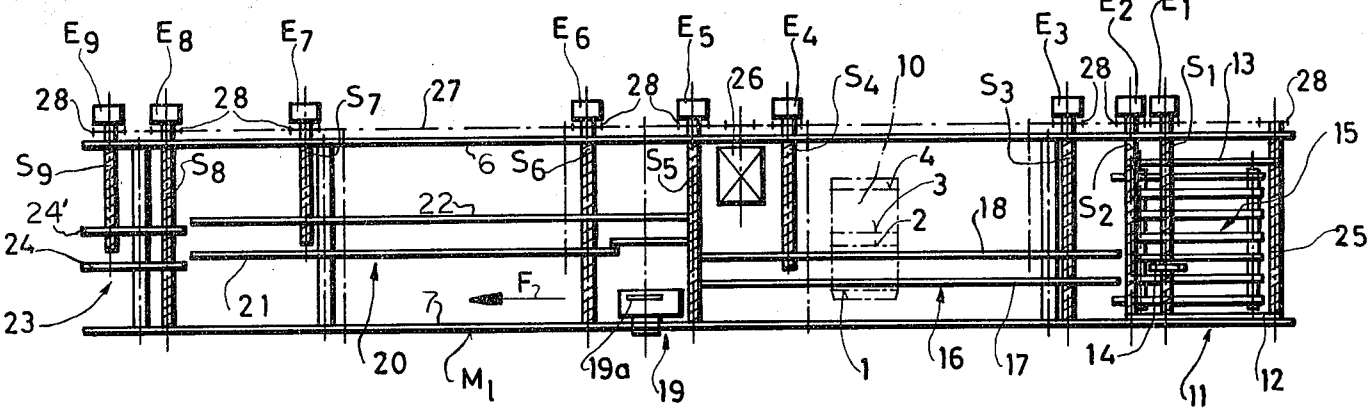

As generally shown in FIGS. 1 and 2 a box-making machine according to this invention is adapted to operate on a flat or planar blank 10 having four crease lines 1–4. The machine has a pair of longitudinally extending and parallel side plates 6 and 7 supported on legs 8 and 9. A conveyor constituted as belts 15 extends longitudinally through the machine from an upstream input station 11 past a first folding station 16, then past a latexing station 19, then past another folding station 20, and finally to an output station 23. It should be understood that there is not a single belt extending the length of the entire machine, but that each of the folding stations of the machine has a separate belt 15 associated with it.

The machine is provided at the input station 11 adjacent the plate 7 with a fixed edge guide 12 and transversely displaceable next to this guide 12 another edge guide 13 that insures that the blanks 10 at the input station 11 are properly aligned parallel to the displacement direction showed by arrow F. A stripper 14 is provided at the input station 11 to insure that only the lowermost blank 10 of a stack at this station 11 is advanced by the belts 15.

A pair of treatment elements or folding bars 17 and 18 is transversely adjustable at the first folding station 16.

At the latexing station 19 a latexing disk **19*a* that applies adhesive to a strip along a flap at the edge of the blank 10** is also transversely displaceable relative to the direction F.

Two more folding bars 21 and 22 also independently transversely displaceable on the machine are provided at the second folding station 20. Finally a pair of relatively and independently displaceable belts 24 and 24' are provided at the output station 23.

Each of the treatment elements 13, 14, 17, 18, 19, 21, 22, 24 and 24' is carried on a pair of respective threaded spindles $S_1$–$S_9$ that are journalled in the two side plates 6 and 7 of the machine and extend perpendicular to the transport direction F. These spindles are arranged in pairs as shown in FIG. 1; it should be noted that in FIG. 1 only one spindle of each pair of fully shown whereas the second spindle of each pair is shown in broken lines. Each of these pairs of spindles $S_1$–$S_9$ is connectable in turn through a respective electromagnetic clutch $E_1$–$E_9$ to a respective sprocket 28. A common drive motor 26 mounted underneath the machine on the plate 6 is connected via a common chain 27 to all of the sprockets 28. All of the spindles of the pairs $S_1$–$S_9$ are of like hand and the same pitch and the sprockets 28 are all of the same diameter so that when all of the clutches $E_1$–$E_9$ are closed all of the treatment elements 13, 14, 17, 18, 19, 21, 22, 24 and 24' will move synchronously transverse to the direction F.

Figure 3:
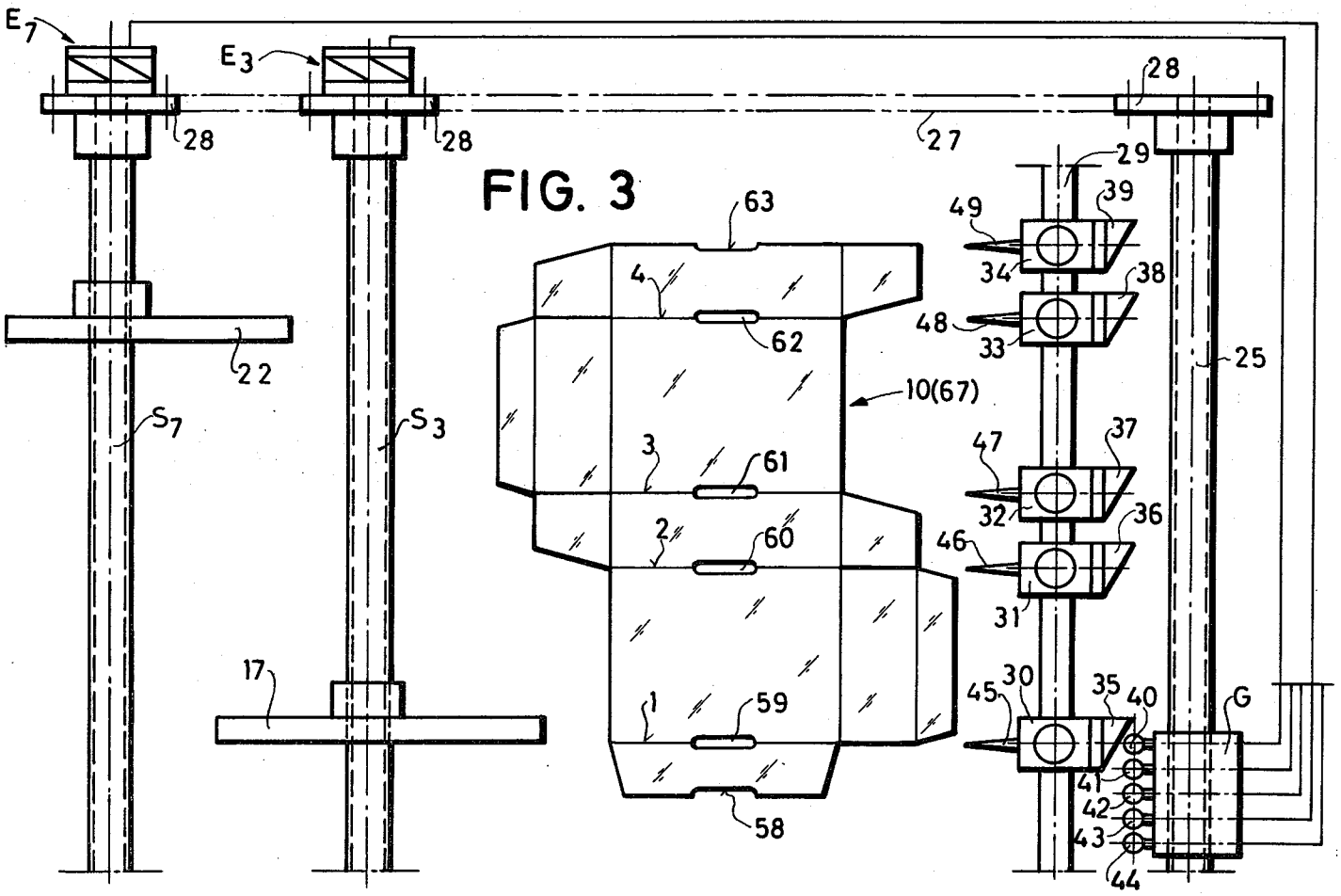
FIG. 3 is a top large-scale view of a detail of FIG. 1.

As also shown in FIG. 3 an alignment or scanning spindle 25 is journalled in the two plates 6 and 7 at the extreme upstream end of the machine above the input station 11. This spindle 25 is identical to the spindles $S_1$–$S_9$ and itself has a sprocket 28 over which the chain 27 is rieved. No clutch is provided, however, between the sprocket 28 of the spindle 25 and the spindle 25. A scanning block or element G is threaded on the spindle 25 and is, therefore, displaceable with the treatment elements on the other spindle. A limit switch is provided at each side 6 and 7 of the machine to arrest the electric motor 26 when the scanning element G comes to rest against either of these sides to prevent damage to it. Similar such end or limit switches are provided that operate the electromagnetic clutches $E_1$–$E_9$ of the spindles $S_1$–$S_9$ to prevent damage to these elements also.

Figure 4:
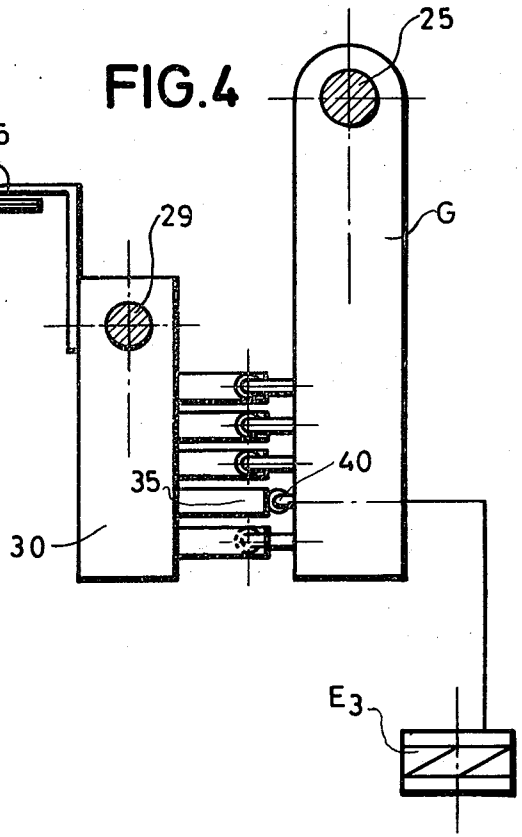
FIG. 4 is an end view of the arrangement of FIG. 3.
Figure 5:
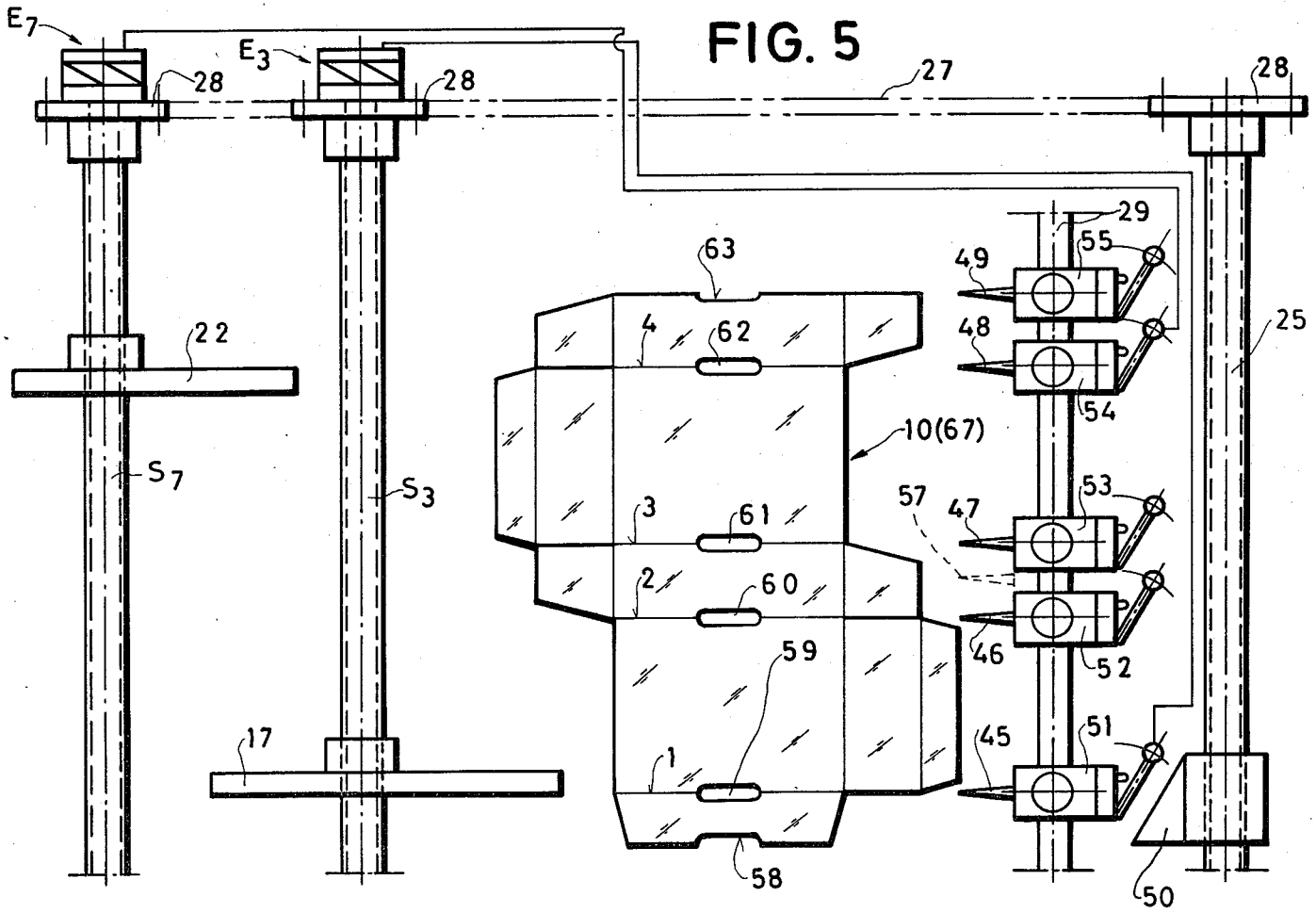
FIG. 5 is a top view similar to FIG. 3 illustrating an alternative arrangement according to this invention.

An alignment guide 29 constituted as a rod extending parallel to the spindle 25 is provided at the input station immediately downstream of the spindle 25. This alignment guide 29 is here shown carrying five blocks or trips 30–34 which can be locked at any position along the guide 29 and which have as shown in FIG. 4 respective tripping formations 35–39 each lying in the same horizontal plane as a respective switch 40–44 carried on the scanning element G. The trips 30–33 have pointers which are aligned with the creases or fold lines 1–4 of the blank 10 and the trip 34 has a pointer 49 which is aligned with that edge of the blank 10 closest to the side plate 6. The switch 40 that is actuatable by the formation 35 of the trip 30 is connected to the electromagnet $E_3$ of the spindle $S_3$ of the treatment element 17. FIG. 3 shows how the switch 40 that is operated by the trip 33 is connected to the electromagnet $E_7$ of the element 22. Similarly the switches 41 and 42 of the trips 31 and 32 are connected to the electromagnets $E_6$ and $E_5$ of the elements 21 and 18. Another such trip may be provided for the spindle $S_5$ of the latexing element 19*a* and the trip 39 is connected to the electromagnet $E_1$ of the edge guide 13. FIG. 5 shows in dash lines how another pointer 57 of a respective trip may be provided for the stripper 14.

The machine described above can be set up for a given blank by first operating the motor 26 while connected via the electromagnets $E_1$–$E_9$ to all of the spindles $S_1$–$S_9$ until all of the treatment elements 13, 14, 17, 18, 19, 21, 22, 24 and 24' are against the one side wall 7 of the machine having an operator station $M_1$. Then the pointers such as the pointers 45–49 are aligned with respective locations on a blank 10 which is laid in the input station 11 directly against the fixed edge guide 12.

The motor 26 is then started up to advance all of the treatment elements and the scanning unit G across the direction F from the side 7 towards the side 6 of the machine. As each of the switches 40–44 is operated by the respective trip formation 35–39 the respective treatment element stops in the exactly corrected position for folding the blank 10 into a three-dimensional box. When the scanning element G comes to rest against the plate 6 of the machine the motor 26 will automatically be shut off. By this time all of the elements will be properly positioned so that the machine can be started up with the supply of the new blanks.

It is also possible as shown in FIG. 5 to use individual position-defining members 51–55 instead of the trips 30–34. Each of these position-defining members 51–55 has a respective microswitch that is operated by a single scanning element or tripping device 50 threaded on the spindle 25. The switches of these position-defining members are, like the switches of FIG. 3, of the type where each actuation merely reverses the switch position so that if on a single actuation turns it off and vice versa.

Figure 6:
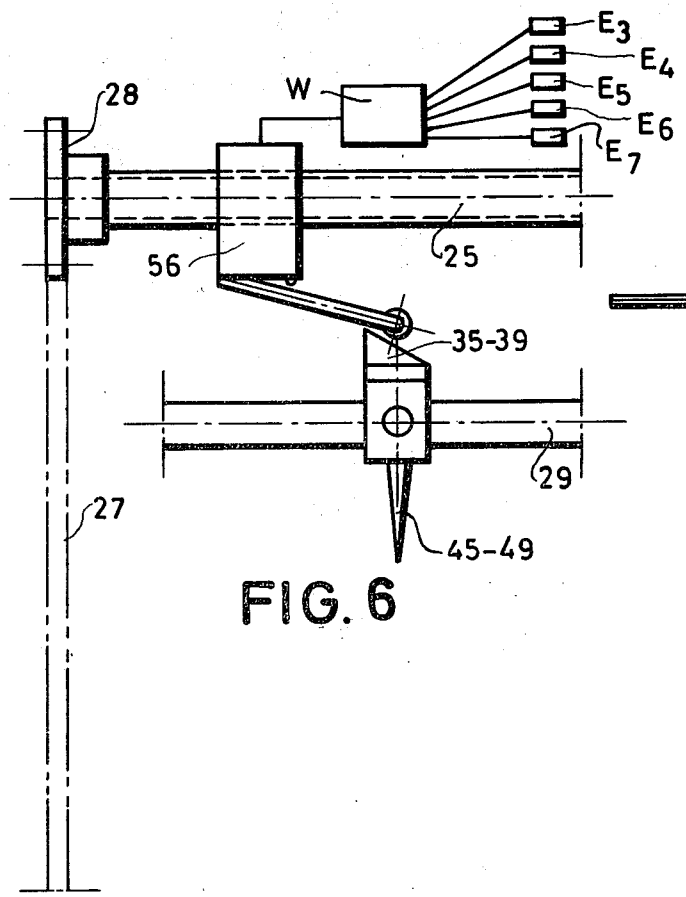
FIGS. 6, 7 and 8 are longitudinal end views through further arrangements according to the present invention.

FIG. 6 shows another arrangement wherein the switches 35–39 shown generically by one switch having a single pointer 45–49 only operate a single switch carried on a single scanning element 56 on the spindle 25. A counter W is provided which operates the various relays $E_3$–$E_7$ in the appropriate sequence as the single switch is tripped by the various different trips 35–39.

Figure 7:
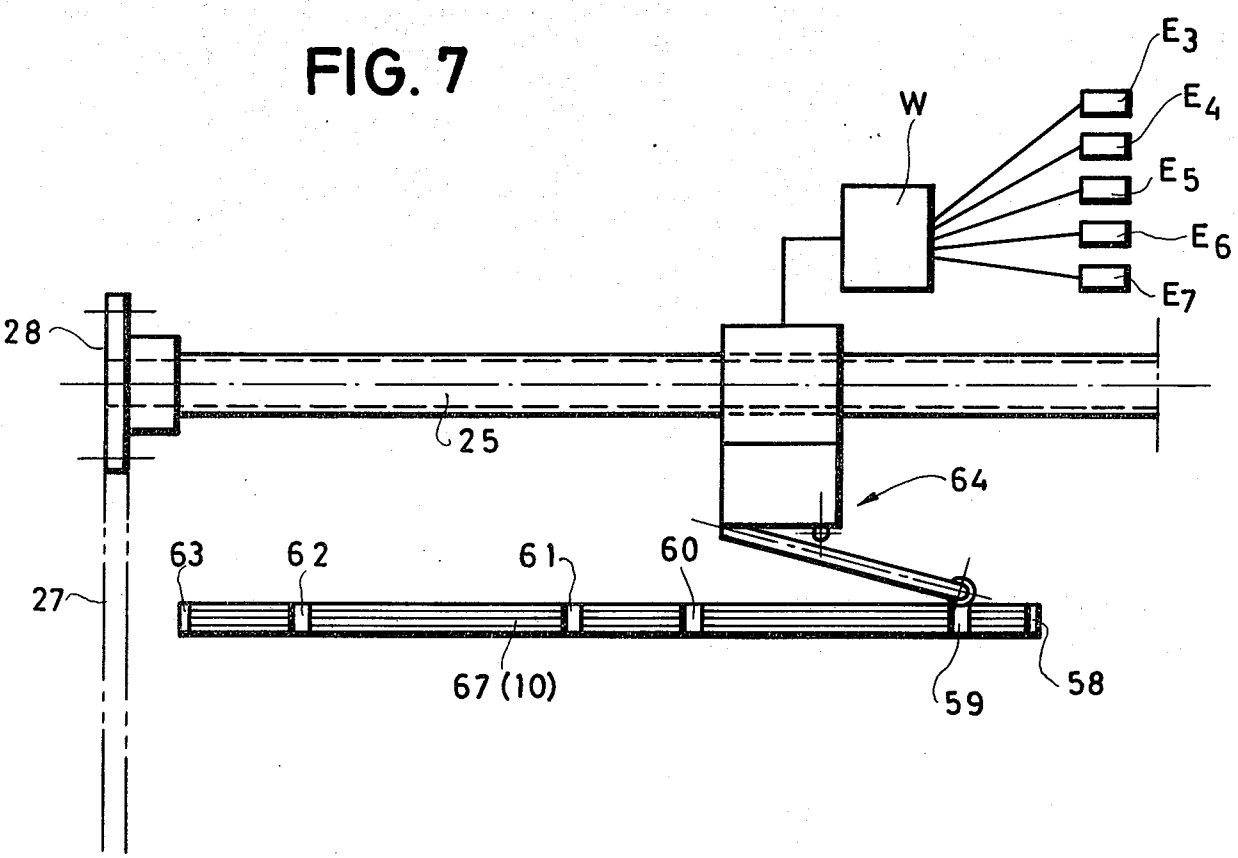

FIG. 7 shows how the blank 10 may be constituted as a pattern 67 formed at its edge with notches 58 and at each of its seams 1–4 with a throughgoing slot 59–62. Here a simple scanning switch 64 displaceable by the spindle 25 is once again connected through a counter W with the appropriate electromagnets.

Figure 8:
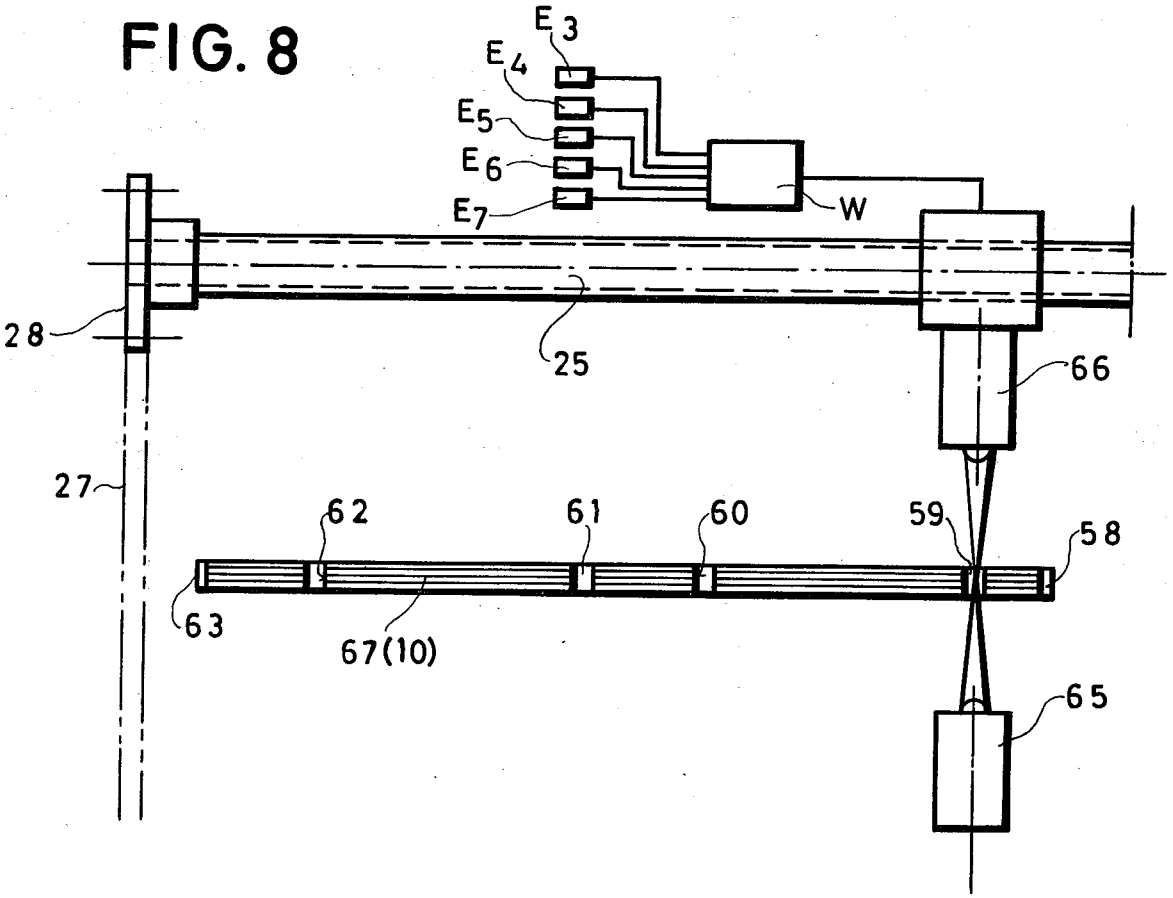

Finally FIG. 8 shows another arrangement wherein the scanning device is constituted as a photocell 66 that is jointly displaceable with a light beam 65 and connected through a counter W to the various electromagnets. The light beam, when it passes through one of the holes 59–62 or one of the notches 58 and 63 operates the counter to open the respective electromagnetic clutch.

With all of the examples given above the blank itself or a pattern identical to the blank is used for setting up the machine. It is also, of course, possible to provide simple dials or other settings that, for instance, are provided adjacent scales that state how many centimeters from the edge of the blank each of the treatment elements is to be placed. Furthermore the entire control station can be placed at a location distant from the machine itself, or at least the alignment guide need not be parallel to the other spindles. Furthermore any of the features of any of the illustrated embodiments can be combined with any of the features of any of the other illustrated embodiments without departing from the scope of this invention.

It will be understood that each of the elements described above, or two or more together, may also find a useful application in other types of machines, differing from the types described above.

While the invention has been illustrated and described as embodied in a box-folding apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for folding a flat blank into a collapsed box, said apparatus comprising:

transport means having a longitudinally extending conveyor for displacing a blank longitudinally through a plurality of longitudinally spaced treatment stations;

treatment means including a respective treatment element at each of said stations displaceable transversely of said conveyor and engageable with a blank thereon for folding a blank passing longitudinally through said station on said conveyor into a collapsed box;

alignment means including an alignment guide extending transverse to said conveyor and a plurality of positioning defining members each associated with a respective treatment element, said position defining members being slidable along said guide and fixable thereon and each including a switch;

scanning means including a single scanning element displaceable parallel to said alignment guide and arranged for engagement with the switch of each position defining member;

actuator means connected to said treatment elements for joint and synchronous displacement of the treatment elements in a direction transverse to said conveyor; and control means in circuit with said switches of said plurality of position defining members and connected to said actuating means for arresting each of said treatment members when said scanning element engages the switch of the respective position defining member.

2. The apparatus defined in claim 1, wherein said actuator means includes a plurality of threaded spindles each extending transversely of said conveyor at a respective station and each threadingly engaging a respective treatment element, and a single motor connectable to all of said spindles.

3. The apparatus defined in claim 2, wherein said actuator means further includes a threaded scanner spindle carrying said scanning element.

4. The apparatus defined in claim 3, wherein said control means includes a plurality of clutches each connected between said motor and a respective spindle of a respective treatment element.

5. The apparatus defined in claim 3, wherein said actuator means further includes a sprocket on each of said spindles and on said motor and a chain interconnecting said sprockets.

6. The apparatus defined in claim 1; further comprising means associated with one of said treatment elements for applying an adhesive in a longitudinal strip to a blank passing longitudinally past said one treatment element.

7. The apparatus as defined in claim 1, wherein said alignment means includes one of said blanks having a plurality of fold lines and wherein said position defining members each have a pointer alignable with the respective fold line.

8. The apparatus as defined in claim 1, wherein said conveyor has an upstream end and wherein said alignment guide extends across said conveyor at said upstream end.

* * * * *